United States Patent [19]

Scheuermann et al.

[11] 4,009,193

[45] Feb. 22, 1977

[54] BISSTYRYLARYL COMPOUNDS

[75] Inventors: Horst Scheuermann, Ludwigshafen; Walter Stilz, Mannheim, both of Germany

[73] Assignee: BASF Aktiengesellschaft, Ludwigshafen (Rhine), Germany

[22] Filed: Dec. 12, 1974

[21] Appl. No.: 532,192

[30] Foreign Application Priority Data

Dec. 22, 1973 Germany ..... 2364396

[52] U.S. Cl. ..... 260/459 A; 260/293.64; 260/240 CA; 260/247.1 R; 260/247.2 B; 260/326.87; 260/465 D; 260/465 E; 260/471 R; 260/471 A; 260/490; 260/501.15; 260/567.6 P; 260/246 B; 260/556 S; 260/558 A; 260/944; 260/945; 8/1 W; 8/DIG. 6; 260/567.6 H; 252/301.21; 252/301.22

[51] Int. Cl.[2] ..... C07C 141/04; C07C 87/68; C07C 121/60

[58] Field of Search ..... 260/459 A, 567.6 P, 260/501.15, 576, 471 R, 471 A, 465 D, 465 E, 490

[56] References Cited

UNITED STATES PATENTS

| | | | |
|---|---|---|---|
| 2,520,275 | 8/1950 | Bois et al. | 260/567.6 P |
| 2,623,902 | 12/1952 | Crossley | 260/567.6 P |
| 3,177,208 | 4/1965 | Stilz et al. | 260/240 |
| 3,283,005 | 11/1966 | Abend et al. | 260/459 A |
| 3,873,312 | 3/1975 | Contois et al. | 260/576 |

FOREIGN PATENTS OR APPLICATIONS

| | | | |
|---|---|---|---|
| 920,988 | 3/1963 | United Kingdom | 260/240 |

*Primary Examiner*—James O. Thomas, Jr.
*Assistant Examiner*—Nicky Chan
*Attorney, Agent, or Firm*—Johnston, Keil, Thompson & Shurtleff

[57] ABSTRACT

Bisstyryl-substituted aryl compounds of the formula (I):

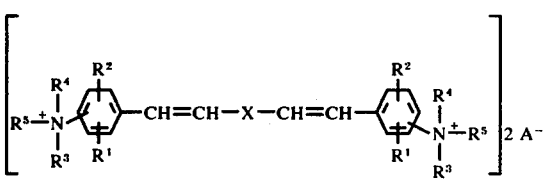

(I)

where X is arylene and $R^1$ and $R^5$ are substituents common to the dye art. The compounds are useful as optical brighteners, particularly for acrylonitrile polymers, and give excellent whitening having good fastness properties.

3 Claims, No Drawings

BISSTYRYLARYL COMPOUNDS

The invention relates to bisstyryl compounds of the formula (I):

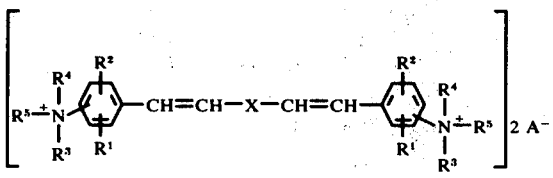

(I)

in which

X is phenylene which is attached to the vinylene groups in the 1-position and in the 4-position and which may bear chlorine, alkyl of one to four carbon atoms or alkoxy of one to four carbon atoms as a substituent; diphenylene which is attached to the vinylene groups in the 4-position and in the 4'-position and which may bear alkyl of one to four carbon atoms, alkoxy of one to four carbon atoms, as chlorine or cyano as a substituent; a 9,10-dihydrophenanthrene radical attached in the 2-position and the 7-position to the vinylene groups; or naphthylene attached in the 1,4-position, 1,5-position or 2,6-position to the vinylene groups;

$R^1$ and $R^2$ are hydrogen, alkyl or aralkyl of one to eighteen carbon atoms; phenyl; phenyl bearing chlorine, methyl or methoxy as substituents; alkoxy of one to twelve carbon atoms; fluorine; chlorine; bromine; cyano; carboxyl; carboxylic ester; carboxamide; alkylsulfonyl of one to four carbon atoms, sulfonic ester or sulfamoyl; $R^1$ and $R^2$ being identical or different;

$R^3$ and $R^4$ are methyl; ethyl or n-propyl which may bear chlorine, methoxy, ethoxy, propoxy, butoxy, phenoxy, acetoxy, carbalkoxy of two to five carbon atoms or cyano as a substituent; n-butyl; benzyl, or phenylethyl; $R^3$ and $R^4$ together with the nitrogen may form a pyrrolidine, piperidine or morpholine ring and may be identical or different;

$R^5$ is alkyl of one to four carbon atoms which may bear hydroxy, chloro, cyano, phenyl, methoxy, ethoxy, propoxy, butoxy, phenoxy, β-carbomethoxy, β-carboethoxy, β-carbopropoxy or β-carbobutoxy as a substituent; and $A^-$ is an anion.

Examples of specific alkyl substituents for the radical X are methyl, ethyl, propyl, n-butyl, isobutyl and tert.-butyl. Examples of alkoxy substituents for X are methoxy, ethoxy, propoxy and butoxy.

In addition to the radicals already mentioned, $R^1$ and $R^2$ may be specifically: methyl, ethyl, propyl, butyl, hexyl, octyl, decyl, dodecyl, cetyl, octadecyl, benzyl, methoxy, ethoxy, butoxy, hexoxy, decoxy, dodecoxy, methoxycarbonyl, ethoxycarbonyl, propoxycarbonyl, butoxycarbonyl, hexoxycarbonyl, 2-ethylhexoxycarbonyl, β-hydroxyethoxycarbonyl, β-methoxyethoxycarbonyl, β-butoxyethoxycarbonyl, methylaminocarbonyl, ethylaminocarbonyl, butylaminocarbonyl, γ-methoxypropylaminocarbonyl, phenylaminocarbonyl, dimethylaminocarbonyl, diethylaminocarbonyl, dibutylaminocarbonyl, pyrrolidinocarbonyl, morpholinocarbonyl, piperidinocarbonyl, methylsulfonyl, ethylsulfonyl, butylsulfonyl, the methyl, ethyl, butyl or phenyl ester of sulfonic acid, or the methylamide, ethylamide, butylamide, γ-methoxypropylamide, phenylamide, dimethylamide, diethylamide, dibutylamide, pyrrolidide, morpholide or piperidide of sulfonic acid.

Specific examples of $R^5$ are: methyl, ethyl, butyl, benzyl, β-hydroxyethyl, β-hydroxypropyl, γ-chloro-β-hydroxypropyl, γ-methoxy-β-hydroxypropyl, γ-butoxy-β-hydroxypropyl, γ-phenoxy-β-hydroxypropyl, β-cyanoethyl, β-carbomethoxyethyl, β-carboethoxyethyl, and β-carbobutoxyethyl.

Examples of anions $A^-$ are: chloride, bromide, nitrate, sulfate, hydrogensulfate, methosulfate, ethosulfate, phosphate, formate, acetate, propionate, benzoate, benzenesulfonate, p-toluenesulfonate, tetrachlorozincate and tetrafluoroborate.

Examples of specific compounds of formula (I) are those resulting from a combination of the radicals indicated in a single row in the following Table:

| X | $R^1$ | $R^2$ | $R^3$ | $R^4$ | $R^5$ | A |
|---|---|---|---|---|---|---|
| 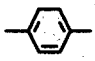 | CN | H | $CH_3$ | $CH_3$ | $CH_3$ | $CH_3SO_4$ |
| 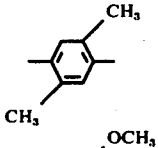 | CN | H | $CH_3$ | $CH_3$ | $CH_3$ | $CH_3SO_4$ |
| 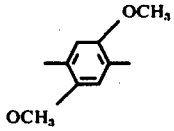 | CN | H | $CH_3$ | $CH_3$ | $CH_3$ | $CH_3SO_4$ |
| 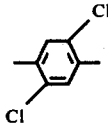 | CN | H | $CH_3$ | $CH_3$ | $CH_3$ | $CH_3SO_4$ |
| 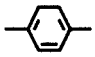 | $CH_3$ | $CH_3$ | $CH_3$ | $CH_3$ | $CH_3$ | $CH_3SO_4$ |
| " | H | H | | $-(CH_2)_5-$ | $CH_3$ | $CH_3SO_4$ |
| " | H | H | | $-(CH_2)_2-O-(CH_2)_2-$ | $C_2H_5$ | $C_2H_5SO_4$ |
| " | H | H | | $-(CH_2)_4-$ | $CH_2CH_2CN$ | $CH_3CO_2$ |

-continued

| X | $R^1$ | $R^2$ | $R^3$ | $R^4$ | $R^5$ | A |
|---|---|---|---|---|---|---|
| 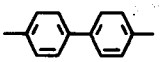 | CN | H | $CH_3$ | $CH_3$ | $CH_3$ | $CH_3SO_4$ |
| " | CN | H | $C_2H_5$ | $C_2H_5$ | $C_2H_5$ | $C_2H_5SO_4$ |
| " | CN | H | $CH_3$ | $CH_3$ | $C_2H_4OH$ | $CH_3CO_2$ |
| " | H | H | $CH_3$ | $CH_3$ | $CH_2-CH(OH)-CH_2OC_6H_5$ | $CH_3CO_2$ |
| " | H | H | $CH_3$ | $CH_3$ | $CH_2-CH(OH)-CH_2Cl$ | $CH_3CO_2$ |
| " | H | H | $CH_3$ | $CH_3$ | $CH_2-CH(OH)CH_2OCH_3$ | $CH_3CO_2$ |
| " | H | H | $CH_3$ | $CH_3$ | $CH_2CH_2CO_2CH_3$ | $CH_3CO_2$ |
| " | H | H | $CH_3$ | $CH_3$ | $CH_2CH_2CO_2C_4H_9$ | $CH_3CO_2$ |
| " | $C_6H_{13}$ | H | $CH_3$ | $CH_2CH_2Cl$ | $CH_3$ | $CH_3SO_4$ |
| " | $C_4H_9$ | H | $CH_3$ | $CH_2CH_2OCH_3$ | $C_2H_5$ | Br |
| " | $CH_2C_6H_5$ | H | $CH_3$ | $CH_2CH_2OC(=O)CH_3$ | $CH_3$ | 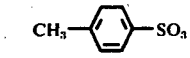 |
| " | H | H | $CH_3$ | $CH_2CH_2CN$ | $CH_3$ | $CH_3SO_4$ |
| " | H | H | $C_2H_5$ | $C_3H_7$ | $CH_3$ | $CH_3SO_4$ |
| " | H | H | $CH_3$ | $CH_2C_6H_5$ | $CH_3$ | $CH_3SO_4$ |
| " | $CH_3$ | H | $CH_3$ | $CH_2CH_2C_6H_5$ | $CH_3$ | $CH_3SO_4$ |
| " | Cl | H | $CH_3$ | $CH_3$ | $CH_3$ | $CH_3SO_4$ |
| " | $OC_2H_5$ | $OC_2H_5$ | $CH_3$ | $CH_3$ | $C_2H_5$ | $C_2H_5SO_4$ |
| " | $OC_6H_{13}$ | H | $CH_3$ | $CH_3$ | $CH_3$ | $CH_3SO_4$ |
| " | $CO_2C_4H_9$ | H | $CH_3$ | $CH_3$ | CH | $CH_3SO_4$ |
| " | $CO_2CH_2CH_2OCH_3$ | H | $CH_3$ | $CH_3$ | $CH_3$ | $CH_3SO_4$ |
| " | $CO_2CH_2CH(C_2H_5)(C_4H_9)$ | H | $CH_3$ | $CH_3$ | $CH_3$ | $CH_3SO_4$ |
| " | $CONHCH_3$ | H | $CH_3$ | $CH_3$ | $CH_3$ | $CH_3SO_4$ |
| " | $CONHC_6H_5$ | H | $CH_3$ | $CH_3$ | $CH_3$ | $CH_3SO_4$ |
| " | $CON(C_2H_5)_2$ | H | $CH_3$ | $CH_3$ | $CH_3$ | $CH_3SO_4$ |
| " | 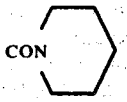 | H | $CH_3$ | $CH_3$ | $CH_3$ | $CH_3SO_4$ |
| " | 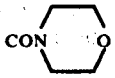 | H | $CH_3$ | $CH_3$ | $CH_3$ | $CH_3SO_4$ |
| " | $SO_2CH_3$ | H | $CH_3$ | $CH_3$ | $CH_3$ | $CH_3SO_4$ |
| " | $SO_2C_2H_5$ | H | $CH_3$ | $CH_3$ | $CH_3$ | $CH_3SO_4$ |
| " | $SO_2C_4H_9$ | H | $CH_3$ | $CH_3$ | $CH_3$ | $CH_3SO_4$ |
| " | $SO_3CH_3$ | H | $CH_3$ | $CH_3$ | $CH_3$ | $CH_3SO_4$ |
| " | $SO_3C_4H_9$ | H | $CH_3$ | $CH_3$ | $CH_3$ | $CH_3SO_4$ |
| " | $SO_3C_6H_5$ | H | $CH_3$ | $CH_3$ | $CH_3$ | $CH_3SO_4$ |
| " | $SO_2NHCH_3$ | H | $CH_3$ | $CH_3$ | $CH_3$ | $CH_3SO_4$ |
| " | $SO_2N(C_2H_5)_2$ | H | $CH_3$ | $CH_3$ | $CH_3$ | $CH_3SO_4$ |
| " | 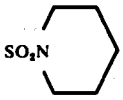 | H | $CH_3$ | $CH_3$ | $CH_3$ | $CH_3SO_4$ |
| " | 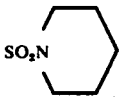 | H | $CH_3$ | $CH_3$ | $CH_3$ | $CH_3SO_4$ |
| " | 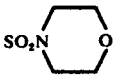 | H | $CH_3$ | $CH_3$ | $CH_3$ | $CH_3SO_4$ |
| " | 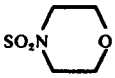 | H | $CH_3$ | $CH_3$ | $C_2H_5$ | $C_2H_5SO_4$ |
| 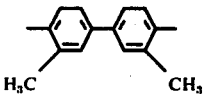 | H | H | $CH_3$ | $CH_3$ | $CH_3$ | $CH_3SO_4$ |
| 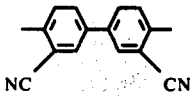 | H | H | $CH_3$ | $CH_3$ | $CH_3$ | $CH_3SO_4$ |

-continued

| X | $R^1$ | $R^2$ | $R^3$ | $R^4$ | $R^5$ | A |
|---|---|---|---|---|---|---|
| 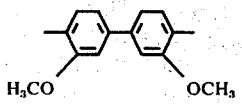 | H | H | $CH_3$ | $CH_3$ | $CH_3$ | $CH_3SO_4$ |
| 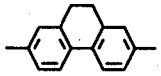 | H | H | $CH_3$ | $CH_3$ | $CH_3$ | $CH_3SO_4$ |
| " | CN | H | $CH_3$ | $CH_3$ | $CH_3$ | $CH_3SO_4$ |
| 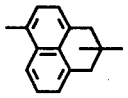 | CN | H | $CH_3$ | $CH_3$ | $CH_3$ | $CH_3SO_4$ |
| | CN | H | $CH_3$ | $CH_3$ | $C_2H_5$ | $C_2H_5SO_4$ |
| " | CN | H | $C_2H_5$ | $C_2H_5$ | $C_2H_5$ | $C_2H_5SO_4$ |
| " | CN | H | $CH_3$ | $CH_3$ | $CH_2CH_2OH$ | $CH_3CO_2$ |
| " | CN | H | $CH_3$ | $CH_3$ | $CH_2CHCH_3$ (OH) | $CH_3CO_2$ |
| 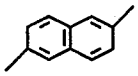 | CN | H | $CH_3$ | $CH_3$ | $CH_3$ | $CH_3SO_4$ |

Particular industrial significance attaches to compounds of the formula (Ia):

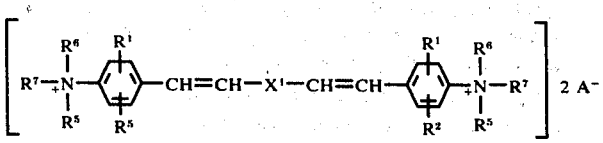

(Ia)

in which $X^1$ is 1,4-phenylene or 4,4'-diphenylene which may bear chloro, methyl or methoxy as a substituent, $R^6$ is methyl or ethyl, $R^7$ is methyl or ethyl or $R^6$ and $R^7$ together with the nitrogen form the radical of pyrrolidine, piperidine or morpholine and $R^1$, $R^2$, $R^5$ and $A^-$ have the above meanings.

Preferred compounds are those of the formula (Ib):

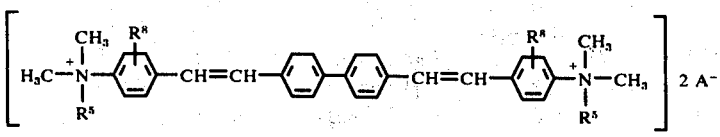

(Ib)

in which $R^8$ is hydrogen, chloro, methyl, methoxy, ethoxy, cyano or carbomethoxy and $R^5$ and $A^-$ have the above meanings. Among these compounds those are particularly preferred in which $R^5$ is methyl, ethyl, benzyl or $\beta$-cyanoethyl.

The compounds according to the invention are colorless to pale yellow in color and have strong fluorescence in dissolved or finely divided condition. They may be used as optical brighteners as additives to detergents or to high or low molecular weight organic materials and particularly to anionically modified textile fibers, for example from acrylonitrile polymers.

Compounds of the formula (I) may be prepared by a conventional method from compounds of the formula (II):

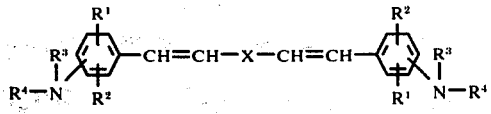

(II)

by the introduction of the radical $R^5$ and the anion $A^-$. Examples of suitable alkylating agents for this quaternizing reaction are alkyl halides such as methyl iodide, ethyl iodide, ethyl bromide, butyl bromide or benzyl chloride; dialkyl sulfates such as dimethyl sulfate or diethyl sulfate; sulfonic acid esters such as the methyl or ethyl esters of toluenesulfonic acid or benzenesulfonic acid; alkylene oxides such as ethylene oxide, propylene oxide or epichlorohydrin, acrylic esters such as methyl, ethyl or butyl acrylate; acrylonitrile; or compounds of the formula:

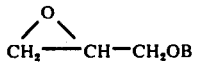

where B is methyl, ethyl, propyl, butyl or phenyl.

Bisstyryl compounds of the formula (II) may be prepared by reacting, in a molar ratio of 1 : 2, a compound of the formula (III):

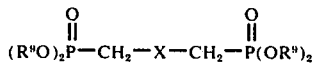

(III)

in which X has the meanings given above and in which $R^9$ is an optionally further substituted alkyl, preferably alkyl of up to six carbon atoms; cycloalkyl, preferably cyclohexyl; or arylalkyl, preferably benzyl, with a compound of the formula (IV):

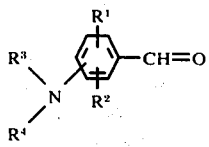

(IV)

in which $R^1$, $R^2$, $R^3$ and $R^4$ have the meanings given above or by reacting a compound of the formula (V):

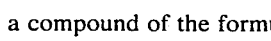

(V)

with a compound of the formula (VI):

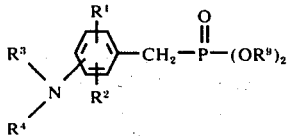

(VI)

in which X, $R^1$, $R^2$, $R^3$, $R^4$ and $R^9$ have the meanings given above.

The phosphorus compounds of the formulae (III) and (VI) may be obtained by reacting a halomethyl compound and preferably a chloromethyl compound of the formula (VII) or (VIII):

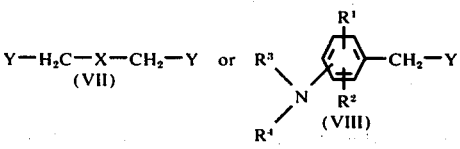

in which X, $R^1$, $R^2$, $R^3$, $R^4$ and $R^9$ have the above meanings, and Y is halogen such as chloro, with a phosphorus compound of the formula:

$P(OR^9)_3$ in which X, $R^1$, $R^2$, $R^3$, $R^4$ and $R^9$ have the above meanings.

The reaction to form compounds of the formula (II) is carried out by allowing the components to react in the presence of a strongly basic alkaline compound and in the presence of a solvent which is preferably hydrophilic and strongly polar.

Examples of suitable solvents are toluene, xylene, chlorobenzene, alcohols such as ethanol, isopropanol or methyl glycol, but preferably N-methylpyrrolidone, dimethylformamide, diethylformamide, dimethylacetamide and dimethylsulfoxide.

The temperature at which this reaction is carried out may be varied within wide limits. The range from 0° to 180° C and preferably from 30° to 100° C is generally used. Particularly suitable strongly basic alkaline compounds are the hydroxides, amides and alcoholates, preferably of primary alcohols of one to four carbon atoms, of the alkali metals lithium, sodium or potassium.

Reactions for the production of compounds of the formula (II) are known in principle and proceed analogously to reactions described in the relevant literature and under comparable conditions. Details may be seen in the Examples.

Quaternization of compounds of formula (II) with alkyl halides, dialkyl sulfates or sulfonic esters to form compounds of the formula (I) is conveniently carried out in a solvent which is inert to the alkylating agent. Examples of suitable solvents are hydrocarbons such as benzene, toluene and xylene; halogenated aliphatic or aromatic hydrocarbons such as chloroform, ethylene chloride, chlorobenzene or dichlorobenzene; alcohols such as ethanol, butanol, ethylene glycol and ethylene glycol monomethyl ether; ethers such as ethylene glycol dimethyl ether and dioxan; or amides such as dimethylformamide or N-methylpyrrolidone.

Quaternization with the said alkylating agents is advantageously carried out at temperatures of from 0° to 180° C and preferably at from 30° to 140° C.

Quaternization of compounds of the formula (II) into compounds of the formula (I) with alkylene oxides, epichlorohydrin and derivatives of the same of the formula:

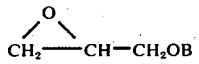

in which B has the above meanings, acrylic esters or acrylonitrile is carried out at the said temperatures in an acid medium and advantageously in the presence of an organic acid such as formic acid, acetic acid, propionic acid or benzoic acid, but inorganic acids such as sulfuric acid, phosphoric acid or hydrohalic acids may also be used for the purpose. These inorganic acids may be used in concentrated commercial form, as dilute solutions or mixed with the said organic solvents with or without the addition of water. When the reaction is carried out in the presence of an organic acid it is usual to employ the acid in concentrated form, if desired mixed with one of the said organic solvents.

The parts and percentages in the following Examples are by weight.

EXAMPLE 1

37.8 parts of dimethyl sulfate is added to 36.8 parts of 1,4-bis-(4-dimethylamino)-styrylbenzene in 200 parts of dimethylformamide at 60° C and this mixture is stirred for 2 hours at 60° C, for 2 hours at 80° C and for 2 hours at 120° C. The whole is allowed to cool. 200 parts of acetone is added. The precipitate is suction filtered, washed with 100 parts of acetone and dried. 40.5 parts (65% of theory) of the following compound is obtained:

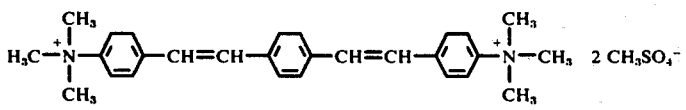

The 1,4-bis-(4-dimethylamino)-styrylbenzene required as starting compound is obtained in the following manner:

A solution of 95 parts of the tetraethyl ester of p-xylylenediphosphonic acid and 90 parts of p-dimethylaminobenzaldehyde in 500 parts of dimethylformamide is added to a mixture of 450 parts of a 30% solution of sodium methylate and 500 parts of dimethylformamide at 45° to 50° C. This mixture is stirred for 6 hours at 55° to 60° C, then poured into 2000 parts of water, cooled, suction filtered and dried. 78 parts (85% of theory) of 1,4-bis-(4-dimethylamino)-styrylbenzene is obtained.

EXAMPLE 2

37.8 parts of dimethyl sulfate is added to 41.8 parts of an about 1 : 1 mixture of 1,4-bis-(4-dimethylamino)-styrylnaphthalene and 1,5-bis-(4-dimethylamino)-styrylnaphthalene in 200 parts of dimethylformamide at 80° C. This mixture is stirred for 2 hours at 80° C and for 2 hours at 125° C. After cooling to 50° C, 200 parts of acetone is added. The whole is suction filtered and the precipitate is washed with 200 parts of acetone and dried. 52 parts (78% of theory) of the following compound is obtained:

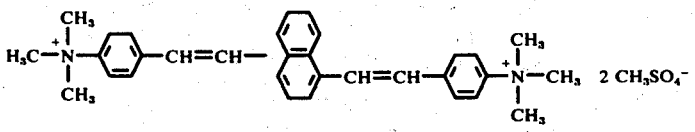

The mixture of 1,4-bis-(dimethylamino)-styrylnaphthalene and 1,5-bis-(4-dimethylamino)-styrylnaphthalene required as starting material is obtained as follows:

A solution of 107 parts of an about 1 : 1 mixture of 1,4-bis-(diethoxyphosphonomethyl)-naphthalene and 1,5-bis-(diethoxyphosphonomethyl)-naphthalene and 90 parts of p-dimethylaminobenzaldehyde in 500 parts of dimethylformamide is added at 45° to 50° C to a mixture of 450 parts of a 30% solution of sodium methylate and 500 parts of dimethylformamide. This mixture is kept for 5 hours at 50° to 55° C and then stirred into 3000 parts of water. The precipitate is suction filtered, washed with water and dried. 74 parts (71% of theory) of a mixture of 1,4-bis-(4-dimethylamino)-styrylnaphthalene and 1,5-bis-(4-dimethylamino)-styrylnaphthalene is obtained.

EXAMPLE 3

37.8 parts of dimethyl sulfate is added to 44.4 parts of 4,4'-bis-(p-dimethylamino)-styryldiphenyl in 200 parts of dimethylformamide at 80° C and this mixture is stirred for 1 hour at 80° C and for 3 hours at 120° C. After the whole has cooled to 50° C 200 parts of acetone is added, and the precipitate is suction filtered, washed with 100 parts of acetone and dried. 55 parts (69% of theory) of the following compound is obtained:

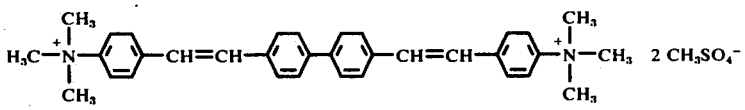

The 4,4'-bis-(p-dimethylamino)-styryldiphenyl required as starting compound is obtained as follows:

A solution of 114 parts of 4,4'-bis-(diethoxyphosphonomethyl)diphenyl and 90 parts of p-dimethylaminobenzaldehyde in 500 parts of dimethylformamide is added at 40° to 45° C to a mixture of 450 parts of a 30% solution of sodium methylate and 500 parts of dimethylformamide. The whole is stirred for 3 hours at 40° to 50° C and for 2 hours at 65° to 70° C. The mixture is poured into 2000 parts of water, and the precipitate is suction filtered, washed with water and dried. 95 parts (86% of theory) of 4,4'-bis-(p-dimethylamino)-styryldiphenyl is obtained.

EXAMPLE 4

The procedure described in Example 3 is repeated but 46.2 parts of diethyl sulfate is used instead of dimethyl sulfate. The whole is stirred for 6 hours at 120° to 125° C. 54 parts (72% of theory) of the following compound is obtained.

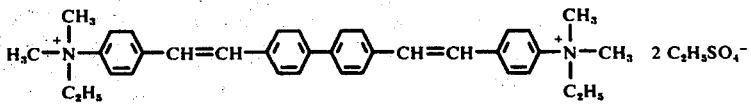

The procedure described in Example 3 is repeated but 36.9 parts of n-propyl bromide, 41.1 parts of n-butyl bromide or 51.3 parts of benzyl bromide is used instead of dimethyl sulfate. The following compounds are obtained:

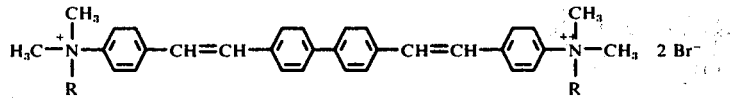

| Example | R | Yield parts | Yield % of theory |
|---|---|---|---|
| 5 | $-CH_2-CH_2-CH_3$ | 51 | 74 |
| 6 | $-CH_2-CH_2-CH_2-CH_3$ | 48 | 67 |
| 7 | $-CH_2-$ 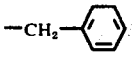 | 66 | 84 |

EXAMPLE 8

17.5 parts of propylene oxide is dripped at 60° C into 44.4 parts of 4,4'-bis-(p-dimethylamino)-styryldiphenyl in 150 parts of glacial acetic acid. After stirring for 3 hours at 60° C and for 5 hours at 80° C the whole is cooled, and the precipitate is suction filtered, washed with acetone and dried. 40 parts (59% of theory) of the following compound is obtained:

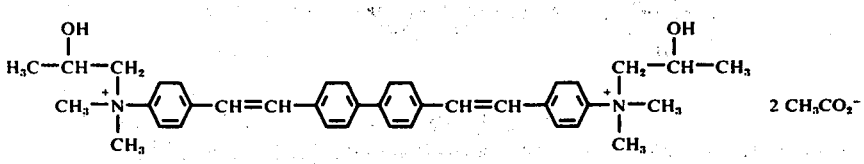

EXAMPLE 9

37.8 parts of dimethyl sulfate is added to 47.2 parts of 4,4'-bis-(2-methyl-4-dimethylamino)-styryldiphenyl in 350 parts of o-dichlorobenzene and this mixture is stirred for 6 hours at 140° C. After the whole has cooled the precipitate is washed repeatedly, each time with 100 parts of acetone, and dried. 41 parts (57% of theory) of the following compound is obtained:

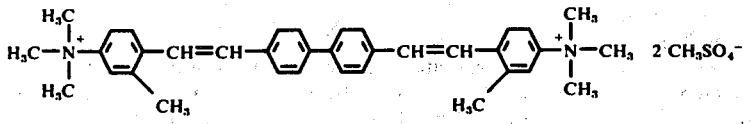

EXAMPLE 10

In the manner described in Example 9 there is obtained from 50.4 parts of 4,4'-bis-(2-methoxy-4-dimethylamino)-styryldiphenyl 44 parts (58% of theory) of the following compound:

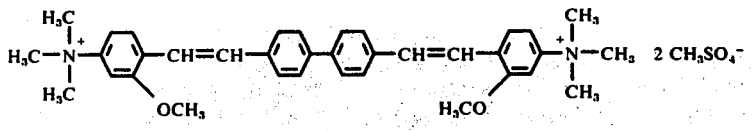

EXAMPLE 11

37.8 parts of dimethyl sulfate is added to 56 parts of 4,4'-bis-(2-carbomethoxy-4-dimethylamino)-styryldiphenyl in 300 parts of dimethylformamide and the whole is stirred for 6 hours at 130° to 135° C and allowed to cool to 50° C. 300 parts of acetone is added and the precipitate is suction filtered, washed with acetone and dried. 52 parts (64% of theory) of the following compound is obtained:

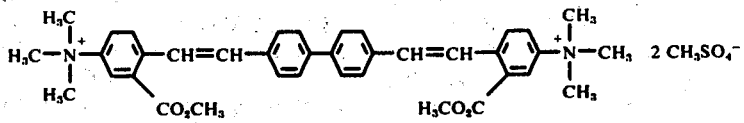

The amino compound required as starting compound is obtained as described in Example 3 using 124.7 parts of 2-carbomethoxy-4-dimethylaminobenzaldehyde instead of 90 parts of p-dimethylaminobenzaldehyde.

EXAMPLE 12

37.8 parts of dimethyl sulfate is added to 39.6 parts of 1,4-bis-(2-methyl-4-dimethylamino)-styrenebenzene in 300 parts of chlorobenzene and the whole is stirred for 6 hours at 130° to 135° C, then allowed to cool to 50° C and 300 parts of acetone is added. The precipitate is suction filtered, washed with 200 parts of acetone and dried. 48 parts (74% of theory) of the following compound is obtained:

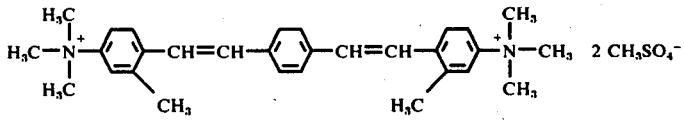

The procedure of Example 12 is repeated but 46.2 parts of diethyl sulfate, 41.1 parts of n-butyl bromide or 51.3 parts of benzyl bromide is used instead of dimethyl sulfate. The following compounds are obtained:

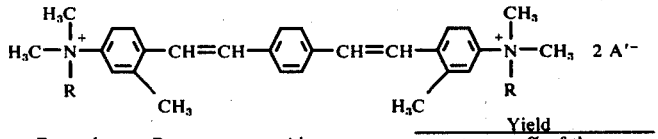

| Example | R | A' | Yield parts | Yield % of theory |
|---|---|---|---|---|
| 13 | $C_2H_5$ | $C_2H_5SO_4^-$ | 39 | 58 |
| 14 | $C_4H_9$ | $Br^-$ | 43 | 64 |
| 15 | $C_6H_5-CH_2$ | $Br^-$ | 45 | 61 |

EXAMPLE 16

50 parts of 4,4'-bis-(4-diethylamino)-styryldiphenyl and 37.8 parts of dimethyl sulfate are heated in 300 parts of dimethylformamide for 6 hours at 120° to 125° C. The whole is allowed to cool to 50° C, 200 parts of acetone is added, and the precipitate is suction filtered, washed with acetone and dried. 55 parts (73% of theory) of the following compound is obtained:

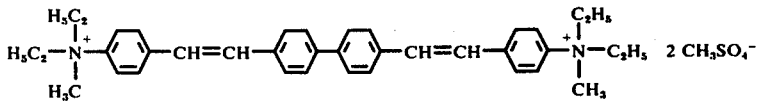

The 4,4'-bis-(4-diethylamino)-styryldiphenyl required as starting compound is obtained in accordance with the process of Example 3 using 106 parts of p-diethylaminobenzaldehyde instead of 90 parts of p-dimethylaminobenzaldehyde.

We claim:

1. A compound of the formula

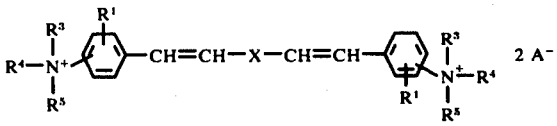

wherein

X is 1,4-phenylene, 1,4-phenylene substituted by chloro, methyl or methoxy or 4,4'-diphenylene, $R^1$ is hydrogen, chloro, methyl, methoxy, ethoxy, cyano or methoxycarbonyl, $R^3$ and $R^4$ are alkyl of 1 to 4 carbon atoms, chloro-, methoxy-, β-ethoxy-, β-acetoxy- or β-cyanoethyl, benzyl or phenylethyl, $R^5$ is alkyl of 1 to 4 carbon atoms, hydroxyalkyl of 2 to 3 carbon atoms, β-hydroxy-γ-chloropropyl, β-cyanoethyl or alkoxycarbonylethyl of 1 to 4 carbon atoms in the alkoxy, and $A^-$ is the chloride, bromide, iodide, methosulfate, ethosulfate, benzenesulfonate or p-toluenesulfonate anion where $R^5$ is said alkyl of 1 to 4 carbon atoms, or $A^-$ is the formate, acetate, propionate or benzoate anion where $R^5$ is said hydroxyalkyl of 2 to 3 carbon atoms, β-hydroxy-γ-chloropropyl, β-cyanoethyl or alkoxycarbonylethyl of 1 to 4 carbon atoms in the alkoxy.

2. A compound according to the formula in claim 1, wherein

X is 1,4-phenylene or 4,4'-diphenylene, $R^1$ is hydrogen, methyl or cyano, $R^3$ and $R^4$ are methyl or ethyl and $R^5$ and $A^-$ have the meanings given for claim 1.

3. The compound according to claim 1 of the formula

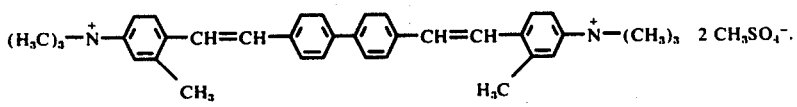

* * * * *